US006435443B1

(12) United States Patent
Lauritzen

(10) Patent No.: US 6,435,443 B1
(45) Date of Patent: Aug. 20, 2002

(54) EQUIPMENT FOR USE ON COVERING A SPORTS STADIUM

(76) Inventor: Jan Kåre Lauritzen, Lundåsen 38, Skien 3719 (NO)

( * ) Notice: Subject to any disclaimer, the term of this patent is extended or adjusted under 35 U.S.C. 154(b) by 0 days.

(21) Appl. No.: 09/424,196

(22) PCT Filed: May 16, 1997

(86) PCT No.: PCT/NO97/00129

§ 371 (c)(1),
(2), (4) Date: Nov. 19, 1999

(87) PCT Pub. No.: WO97/44549

PCT Pub. Date: Nov. 27, 1997

(30) Foreign Application Priority Data

May 20, 1996 (NO) ..... 962037
May 13, 1997 (NO) ..... 972182

(51) Int. Cl.[7] ..... B65H 75/48; B65H 75/40
(52) U.S. Cl. ..... 242/390.9; 242/392; 242/919
(58) Field of Search ..... 242/390.8, 390.9, 242/918, 919, 390, 390.5, 392

(56) References Cited

U.S. PATENT DOCUMENTS 3,108,804 A 10/1963 Wagner
3,273,171 A * 9/1966 Lamb ..... 242/919 X
3,403,870 A * 10/1968 Garaboux ..... 242/919 X
3,473,755 A 10/1969 Brown
4,632,329 A * 12/1986 Burley ..... 242/390.8
4,640,469 A 2/1987 Mackintosh
5,067,184 A * 11/1991 Last ..... 242/390.9 X

FOREIGN PATENT DOCUMENTS

FR 2 527 465 5/1982

OTHER PUBLICATIONS

International Search Report dated Aug, 13, 1997 for PCT/NO97/00129.
International Preliminary Examination Report dated Mar. 18, 1998.

* cited by examiner

*Primary Examiner*—Michael R. Mansen
*Assistant Examiner*—Minh-chau Pham
(74) *Attorney, Agent, or Firm*—Merchant & Gould PC

(57) ABSTRACT

A covering equipment for use on sports arenas for protection against precipitation is shown. The equipment comprises a driving motor (6, 9) and a longitudinal drum (14) for coiling and uncoiling a covering sheet, such as a tarpaulin or plastic coversheet. The casing (6) for the driving motor is arranged so as to rotate independently relative to the elongate drum (14), the motor drive shaft (9) is rigidly connected to the drum (14) for rotation therewith, and the motor casing (6) is fixedly connected to a reaction arm (2) which makes contact with the gound, so that during motor operation the casing (6) of the driving motor remains stationary with respect to rotation while the drum (14) is driven round.

10 Claims, 2 Drawing Sheets

EQUIPMENT FOR USE ON COVERING A SPORTS STADIUM

TECHNICAL FIELD

The present invention relates to covering equipment for use on sports arenas for protection against precipitation, which equipment comprises a driving motor, a longitudinal drum for coiling and uncoiling a covering sheet, such as a tarpaulin or plastic coversheet.

The equipment has been developed for automated covering of sports arenas, and is intended particularly for soccer fields and tennis courts.

BACKGROUND OF THE INVENTION

For several decades, tarpaulins and plastic coversheet have been used for covering sports arenas to protect them against precipitation in order to avoid soaked soccer fields which rapidly turn a nice grass turf into a pool of mud. In addition, many sports arenas today have a source of heat installed in the ground, and the coversheets drawn over the surface may then be used to achieve a form of hothouse effect, with early growth of grass which gives an extended playing season.

For a long time, there have been used long steel or plastic tubes or drums of coiled cover material, which is rolled out and in again by manual power. There have gradually also been developed many different types of machinery connected to the drum to facilitate the work of covering the various playing surfaces. A feature common to all these earlier machines is that the drive of the drum is provided from a side-running machine having its own driving gear, or from some form of wires and gears on tracks.

The earlier equipment may be divided into two different, principal systems for rolling the covering material in and out. These show differences in the time it will take to roll the material in or out, and in the costs of purchasing and the installation of the equipment.

A first version, and the least expensive one, uses only one machine. Thus it is necessary to move the machine between several drums of cover material. The time it will take to cover the surface of an entire field will depend on how many rolls of material are needed due to the size of the field. A single person will be sufficient to drive the equipment.

A second version uses two machines. It will then be necessary to drive overlapping machines. This means that the machine driven as no. 2 will be laid upon the material from the first machine. This solution is somewhat more expensive than the first one, but it will be far more economical in terms of time. Furthermore, two people are needed in order to operate the equipment.

SUMMARY OF THE INVENTION

The third and new version is of the type mentioned in the introduction, which is characterized in that the casing for the driving motor is arranged so as to rotate independently relative to the elongate drum, the motor drive shaft is rigidly connected to the drum for rotation therewith, and the motor casing is fixedly connected to a reaction arm which makes contact with the ground or base surface so that, during motor operation, the casing of the driving motor remains stationary with respect to rotation while the drum is driven round.

This equipment has the advantage that it may be operated by only one person, and the coiling drum may have a considerable longitudinal extension so that only one run, or very few runs, will be necessary. This equipment will also have a relatively simple and inexpensive structural design, and it is easy to handle.

The reaction arm may advantageously be equipped with a ground contacting wheel at the distal end area thereof relative to the elongate drum.

While not strictly necessary, the driving motor may be positioned within a rigid, surrounding motor housing if the inherent rigidity in the casing for the driving motor itself is insufficient.

Further, the driving motor may include a reduction gear unit, in order that a smaller motor with lower power efficiency may be used for the equipment.

Preferably the drum may be rotatably mounted within the rotatively stationary motor housing in close proximity to the reaction arm. The transmission of power from the drive shaft to the elongate drum may take the form of an inner sleeve and an outer sleeve radially joined by a web plate where the inner sleeve is connected to the drive shaft. The drive shaft may be connected to the inner sleeve by means of a threaded expander socket coupling, and an outer sleeve may be connected to the elongate drum via bolt or rivet connections or other suitable fastening means.

Preferably a center axle may be disposed centrally along the entire longitudinal extension of the elongate drum for transmission of power from the drive shaft to the drum at more than one point along said longitudinal extension.

It is conceivable that the driving motor could well be positioned externally of the drum, but in the currently most practical embodiment of the covering equipment, the driving motor is disposed internally at one end of the elongate drum. It is also conceivable that, if the elongate drum were to have an exceedingly great longitudinal extension, another driving motor should be mounted in the drum at the opposite end thereof.

BRIEF DESCRIPTION OF THE FIGURES

Other additional objectives, features and advantages will be apparent from the following description of a currently preferred embodiment of the invention, which is provided for the purpose of description without thereby being restrictive, and is presented in connection with the accompanying drawings where.

DETAILED DESCRIPTION OF THE INVENTION

Figure 1:
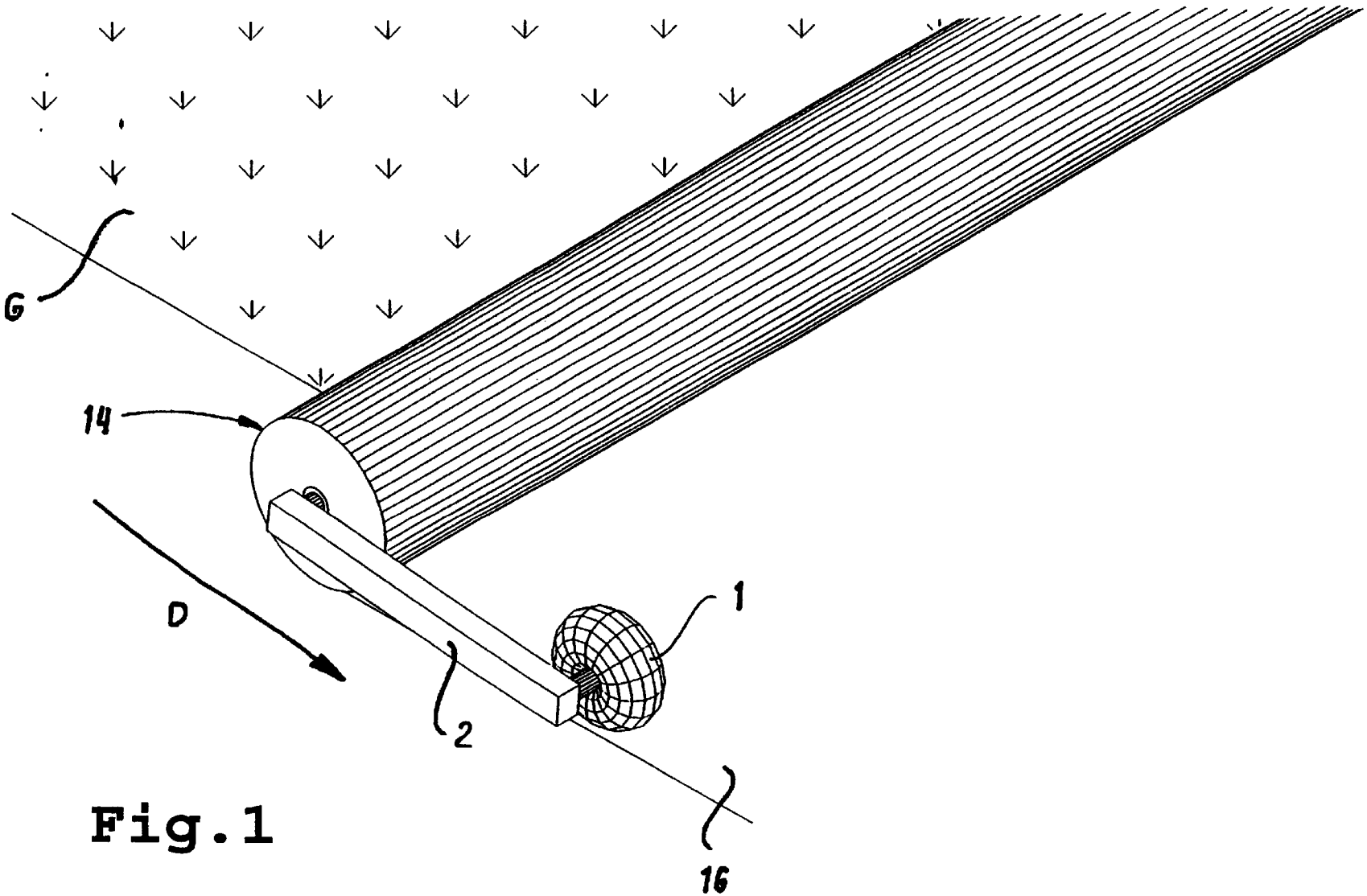
FIG. 1 is a perspective view of the covering equipment in use on a grass turf while a covering sheet is being coiled.

FIG. 1 is a schematic illustration of the covering equipment according to the invention. As mentioned above, the covering equipment is designed particularly for sports arenas for the covering of such areas as grass fields G. The covering equipment moves in the driving direction D. The figure shows the coiling or winding in of a covering sheet 16, such as a tarpaulin or a reinforced plastic cover shut, which disposes itself in layers onto the drum 14 as the drum is rolled in direction D. A driving motor is positioned within the drum itself 14, and the motor is prevented from rotating by means of a reaction arm 2 having a wheel 1 mounted at the outer end thereof. As the cover sheet 16 is rolled out from drum 14, the reaction arm 2 with wheel 1 will be rotated 180° about the center axis of drum 14, this being the opposite direction to that shown on FIG. 1.

Figure 2:
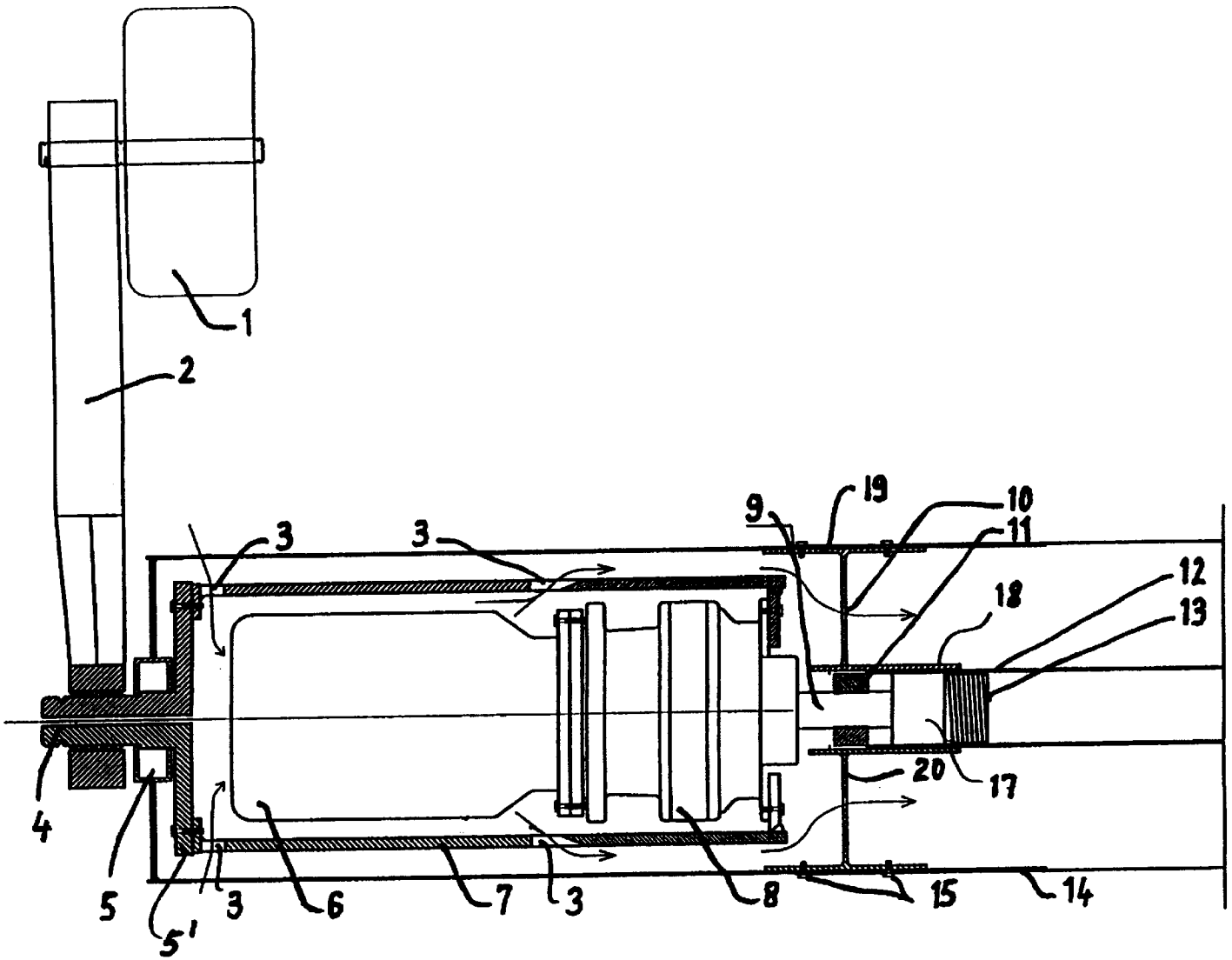
FIG. 2 is a longitudinal section through an end portion of an elongate coiling drum where the driving motor is positioned within the end of the drum.

FIG. 2 shows in more detail how the operation and transmission of power occurs from the driving motor 6, 9 to drum 14. It should be noted at this point that, in the illustrated embodiment, motor 6, 9 is positioned inside drum 14, but there is no reason in principle why motor 6, 9 may not be placed externally of drum 14, that is, as a continuation of the part, having reference number 4. This, however, would be a less practical and attractive embodiment of the covering equipment.

More specifically, FIG. 2 shows a motor casing 6 from which extends a drive shaft 9 which is rigidly connected to drum 14 for rotation therewith. Drive shaft 9 is connected to a reduction gear unit 8, such as a planetary gear, and the motor is thereby geared down to allow a less powerful motor to drive drum 14 around. Reference number 4 refers to a cable lead-in for electric current to motor 6, 9. Motor casing 6 is enclosed by a housing 7 for the driving motor, having therein a number of ventilation holes 3 for discharge of heat energy generated during operation. Motor casing 6 is secured to driving motor housing 7 at the forward edge thereof by means of bolts. Driving motor housing 7 is also connected securely to the reaction arm 2, which at the distal end thereof relative to drum 14 is provided with a surface contacting wheel 1. As mentioned above, this reaction arm 2 prevents motor casing 6, via driving motor housing 7, from rotating when drive shaft 9 of the driving motor turns around. Wheel 1 is free-running on reaction arm 2 and prevents said arm from becoming embedded in the surface or the ground. Wheel 1 may be replaced, however, by a skid, runner or similar device, although a wheel is absolutely practical. By this it should be understood that motor casing 6 and driving motor housing 7 always remain stationary relative to drum 14 with respect to rotation, but they of course move together with drum 14 along the grass field G during the covering or uncovering thereof.

Drum 14 is rotatably mounted at the end most proximate to the reaction arm 2 in a bearing 5, such as a ball bearing, slide bearing or roller bearing.

At the end of motor housing 7, opposite to the end with the reaction arm 2, there is provided a form of power transmission from drive shaft 9 to drum 14. Drive shaft 9 has mounted at the end thereof a threaded expander screw 13 which is screwed into a socket 17 and expands the latter for a secure frictional engagment with an inner sleeve member 18, which in turn is connected to an outer sleeve member 19 via a web plate 20 extending radially relative to the drum 14. Outer sleeve 19 is in turn fastened to the drum 14 with the aid of bolt connections 15. Drive shaft 9 is mounted in sleeve 18 with the aid of a bearing 11, such as a ball bearing, roller bearing or slide bearing. The web plate 20 has holes 10 therein to assist with the air ventilation to transport heat energy away from the motor during operation.

Centrally disposed in drum 14 is also a longitudinal center axle 12 capable of transmitting driving power to a plurality of points along the longitudinal extension of the drum 14. This is especially necessary when drum 14 has a considerable longitudinal extension.

It should further be understood that driving motor housing 7 is necessary only when the motor casing 6 does not have the required rigidity to transmit the reaction torque during operation. One could imagine that motor the casing 6 were bolted directly to rear the plate 5'. Nor is center axle 12 absolutely necessary, either, if the drum has a short length and the walls of drum 14 have the requisite torque rigidity.

When the covering equipment is to be driven, it may be advantageous to utilize remote control over a radio transmitter, and there is need for no more than one person, who would be able to complete the covering of a soccer field in less than 3 minutes. It should be understood that, in covering an arena, the reaction arm 2 is thrown 180° to the opposite side relative to the position of the arm in uncovering of the arena.

What is claimed is:

1. Covering equipment for protecting sports arenas against precipitation, the covering equipment comprising:

a driving motor having a motor drive shaft;

an elongate drum for coiling and uncoiling a covering sheet;

a casing for the motor, the casing positioned within the elongate drum such that the drum can rotate independently of the casing;

a single reaction arm located proximate the motor casing;

an inner sleeve that is connected to the drive shaft;

an outer sleeve; and a web plate joining the inner sleeve and the outer sleeve;

wherein the sleeves and the web plate transmit power from the drive shaft to the elongate drum, to rotate the drum, and wherein the motor casing is fixedly connected to the reaction arm, said reaction arm configured to make contact with a ground or base surface so that during motor operation the casing of the driving motor remains stationary with respect to rotation while the drum is being turned.

2. The covering equipment of claim 1, wherein the reaction arm comprises a ground engaging wheel at a distal end thereof, relative to the elongate drum.

3. The covering equipment of claim 1, wherein the driving motor is positioned within a rigid, surrounding motor housing.

4. The covering equipment of claim 3, wherein the elongate drum is rotatably mounted around the motor housing in close proximity to the reaction arm and wherein the motor housing is non-rotating.

5. The covering equipment of claim 1, wherein the driving motor further comprises a reduction gear unit.

6. The covering equipment of claim 1, further comprising: a threaded expander socket coupling that connects the drive shaft to the inner sleeve; and screw connections that connect the outer sleeve to the elongate drum.

7. The covering equipment of claim 1, further comprising: a threaded expander socket coupling that connects the drive shaft to the inner sleeve; and rivet connections that connect the outer sleeve to the elongate drum.

8. The covering equipment of claim 1, further comprising a bearing positioned within the inner sleeve, wherein the drive shaft is rotatably mounted in the bearing.

9. The covering equipment of claim 1, wherein the driving motor is disposed internally at an end of the elongate drum.

10. Covering equipment for protecting sports arenas against precipitation, the covering equipment comprising:

a driving motor having a motor drive shaft;

an elongate drum for coiling and uncoiling a covering sheet;

a center axle that is disposed centrally along a longitudinal axis of the drum, the center axle transmitting power from the drive shaft to the drum at more than one point along the longitudinal axis of the drum;

a casing for the motor, the casing positioned within the elongate drum such that the drum can rotate independently of the casing;

a single reaction arm located proximate the motor casing; and wherein the motor drive shaft is in driving engagement with the drum to rotate the drum, and wherein the motor casing is fixedly connected to the reaction arm, said reaction arm configured to make contact with a ground or base surface so that during motor operation the casing of the driving motor remains stationary with respect to rotation while the drum is being turned.

* * * * *